US007360321B2

(12) United States Patent
Su

(10) Patent No.: US 7,360,321 B2
(45) Date of Patent: Apr. 22, 2008

(54) DRYER FOR FRUIT AND VEGETABLE

(75) Inventor: Yung Sen Su, Tainan (TW)

(73) Assignee: Chang Yue Industrial Corp., Tainan (TW)

( * ) Notice: Subject to any disclaimer, the term of this patent is extended or adjusted under 35 U.S.C. 154(b) by 944 days.

(21) Appl. No.: 10/704,730

(22) Filed: Nov. 12, 2003

(65) Prior Publication Data

US 2005/0098048 A1 May 12, 2005

(51) Int. Cl.
*F26B 19/00* (2006.01)

(52) U.S. Cl. ..... 34/90

(58) Field of Classification Search ..... 34/90
See application file for complete search history.

(56) References Cited

U.S. PATENT DOCUMENTS 5,261,168 A * 11/1993 Li ..... 34/197

* cited by examiner

*Primary Examiner*—S. Gravini
(74) *Attorney, Agent, or Firm*—Leong C. Lei

(57) ABSTRACT

The dryer is disclosed. The dryer comprises a base seat, at least a netted-rack and a top cover, the top portion of the base seat being mounted with a cutting for fruit and vegetable or a netted-rack for placement of food, and the top portion of the netted-rack being disposed with the top cover, characterized in that a heater is mounted to the base seat and an upward fan, and the external side is a wind hood having a center air opening for suction of hot air and an air-screen at the side for discharging of hot air, the top and bottom of the netted-rack are supporting blocks which can be turned over 180 degree and can be stacked or placed alternately and the top cover at the uppermost layer of the netted-rack is provided with a supporting block so as to increase and decrease the distance between the supporting blocks.

1 Claim, 6 Drawing Sheets

DRYER FOR FRUIT AND VEGETABLE

BACKGROUND OF THE INVENTION (a) Technical Field of the Invention

The present invention relates to a dryer, and in particular, a dryer for drying fruits and/or vegetables, having a heater fan so that hot air can be circulated within a space for storage.

(b) Description of the Prior Art

Referring to FIGS. 1, 2A and 2B, there are shown conventional dryer 1 for fruits and vegetables, including a base seat 10, a net rack 11, a top cover 12, wherein the base seat 10 is mounted with a net rack 11 mounted with a top cover 12. A motor 101 is positioned below the base seat 10 to blow air upward. The external side of the fan 103 is a blowing cavity 102 having an air outlet 104. The top face and the bottom face of the base seat 10 is an inlet netted hole 106 for heater 107 and outlet netted hole 101 for placing of netted rack 11 for cutting 2. The center of the netted board 110 is an air opening 111 and the circumferential edge is a folded section 113. The top cover 12 has an upper air opening 120. A motor 105 and a fan 103 are used to suck air from the upper air opening 120 of the top cover 12 downward, and heat from the heater 107 is used to blow hot air upward the netted board 110. The disadvantage of the conventional dryer is that the hot air will be sucked downward and the hot air cannot be fully used. Thus, heat energy is wasted and the drying time is thus extended. Further, the upper inner side edge 112 is used to stack with the folded section 113, the space cannot be adjusted.

Accordingly, it is an object of the present invention to provide a dryer for fruit and vegetable, which mitigates the above drawbacks.

SUMMARY OF THE INVENTION

Accordingly, it is an object of the present invention to provide a structure of a fruit and vegetable dryer comprising a base seat, at least a netted-rack and a top cover, the top portion of the base seat being mounted with a cutting for fruit and vegetable or a netted-rack for placement of food, and the top portion of the netted-rack being disposed with the top cover, characterized in that a heater is mounted to the base seat and an upward fan, and the external side is a wind hood having a center air opening for suction of hot air and an air-screen at the side for discharging of hot air, the top and bottom of the netted-rack are supporting blocks which can be turned over 180 degree and can be stacked or placed alternately and the top cover at the uppermost layer of the netted-rack is provided with a supporting block so as to increase and decrease the distance between the supporting blocks.

Yet another object of the present invention is to provide a dryer for fruits and vegetables wherein the hot air can be recycled from the bottom upward to the vegetables and fruits, and the height of the netted rack space and the top cover can be increased.

The foregoing object and summary provide only a brief introduction to the present invention. To fully appreciate these and other objects of the present invention as well as the invention itself, all of which will become apparent to those skilled in the art the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
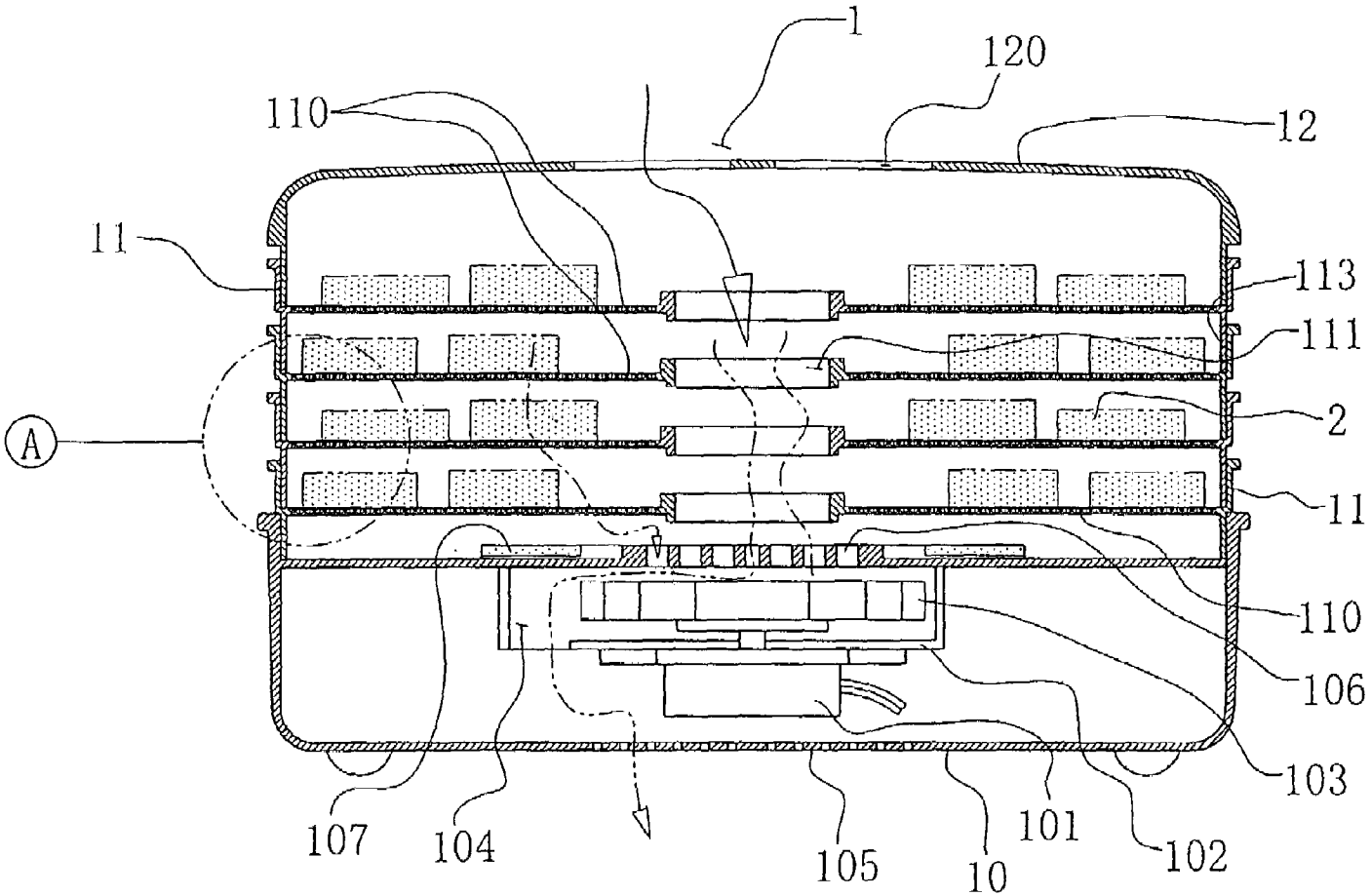
PRIOR ART FIG. 1
FIG. 1 is a sectional view of a conventional fruit and vegetable dryer.
Figure 2A:
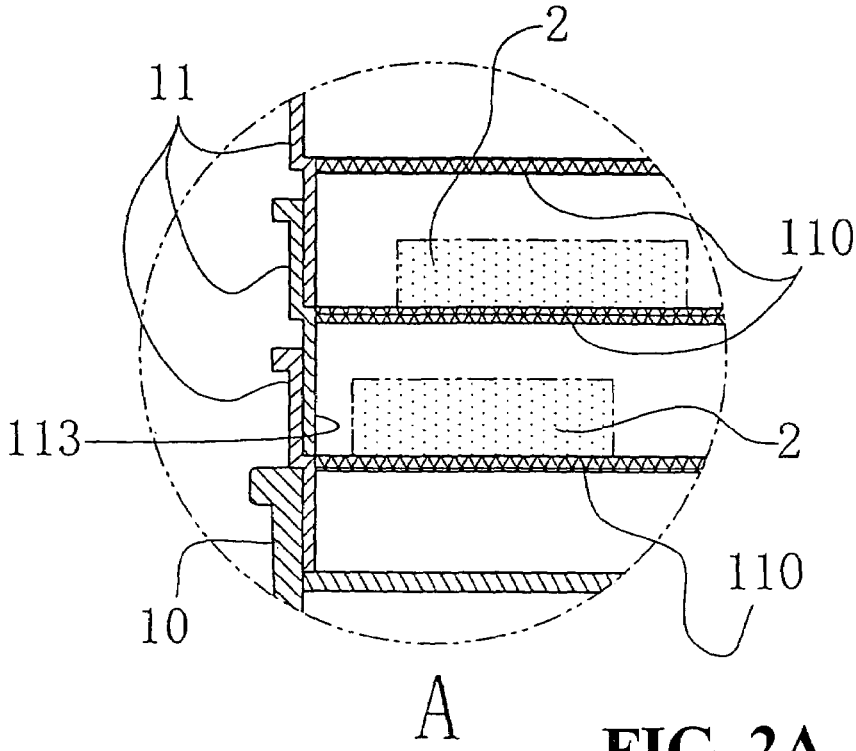
FIG. 2A is an enlarged view of portion A of FIG. 1.
Figure 2B:
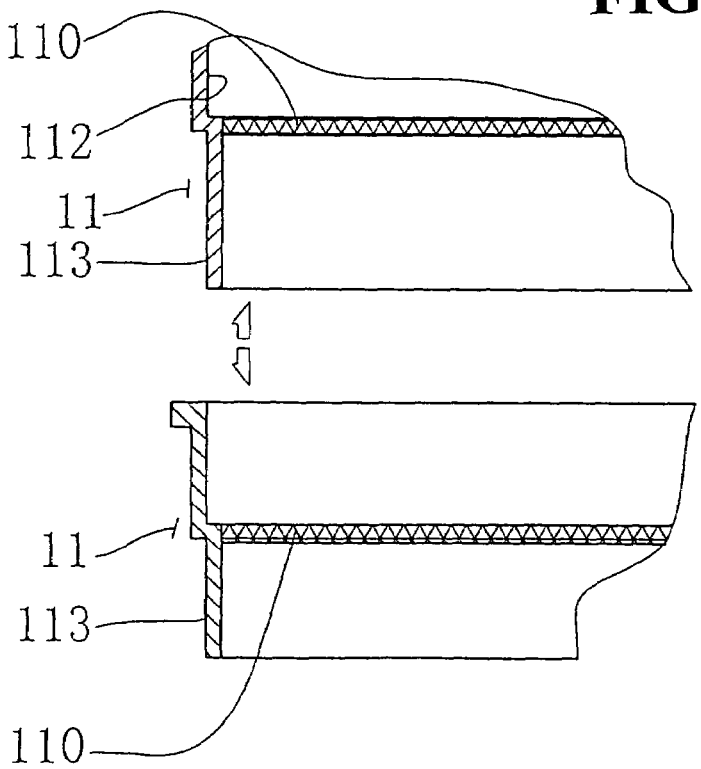
FIG. 2B is an exploded view of the dryer of FIG. 1.
Figure 3:
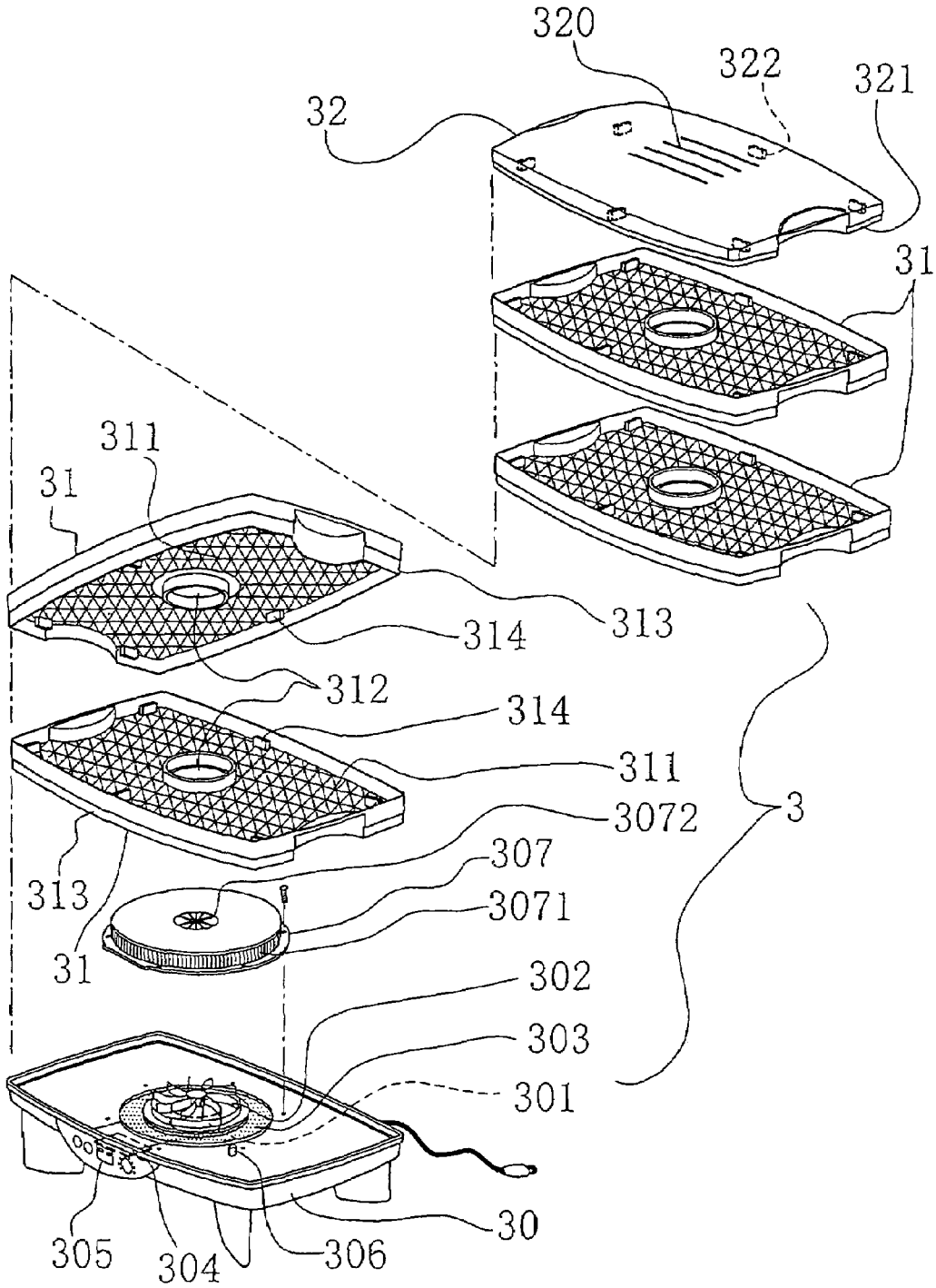
FIG. 3 is a perspective exploded view of the dryer of the present invention.
Figure 4:
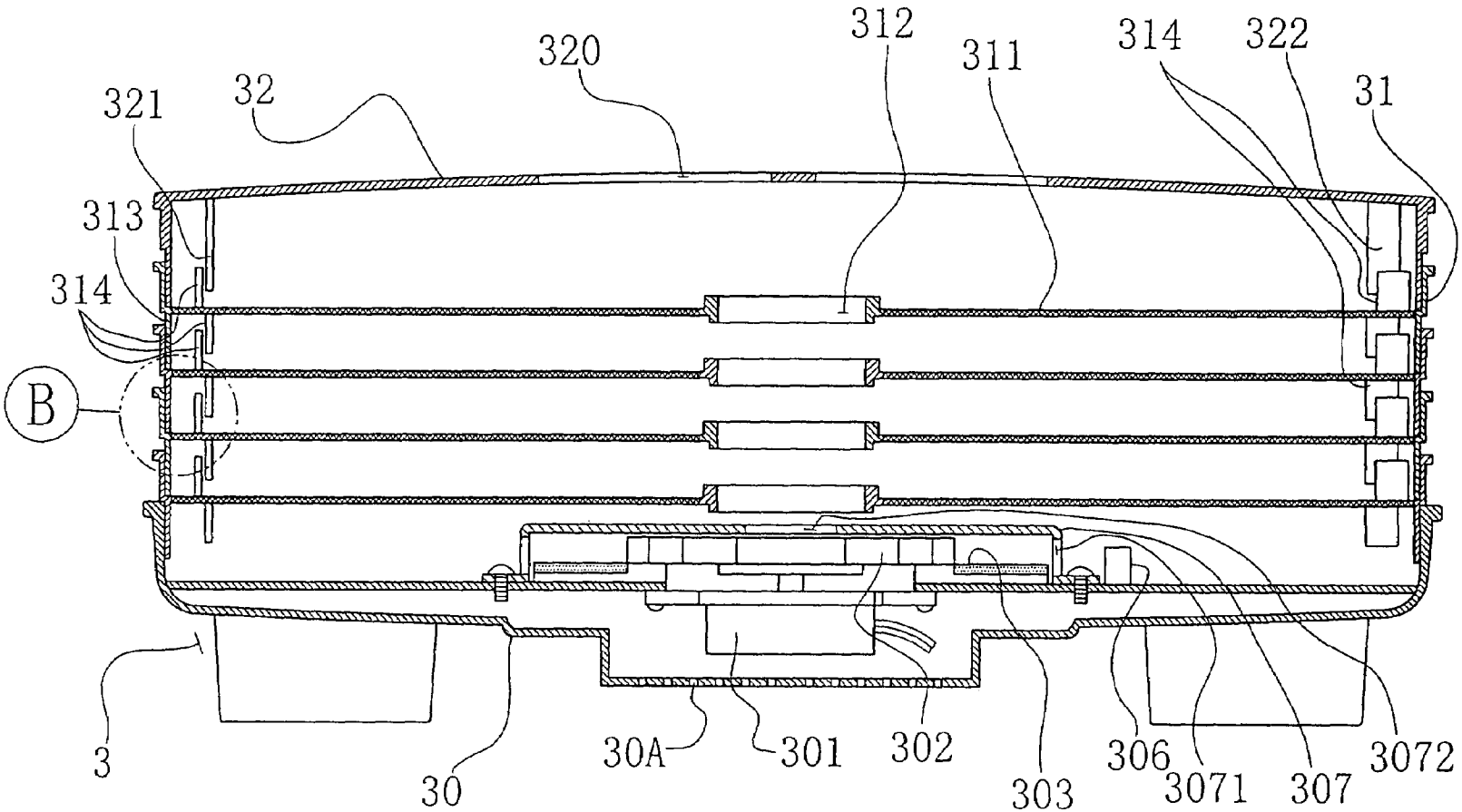
FIG. 4 is a section view of the dryer of the present invention.

Referring to FIGS. 3 and 4, there is shown a dryer 3 for vegetables and fruits, comprising a base seat 30, a plurality of netted racks 31, a top cover 32, wherein the netted rack 31 is mounted at the top of the base seat 30 and the top cover 32 is mounted at the top of the netted rack 31. The base seat 30 is provided with a motor 301, and an upward fan 302 is provided on the base seat 30, and the surrounding of the base seat 30 is a heater 303 to provide heat energy, and the outside of the fan 302 and the heater 303 is covered with a hood 307 providing hot air recycling and providing hot air being blowing downward.

Figure 5:
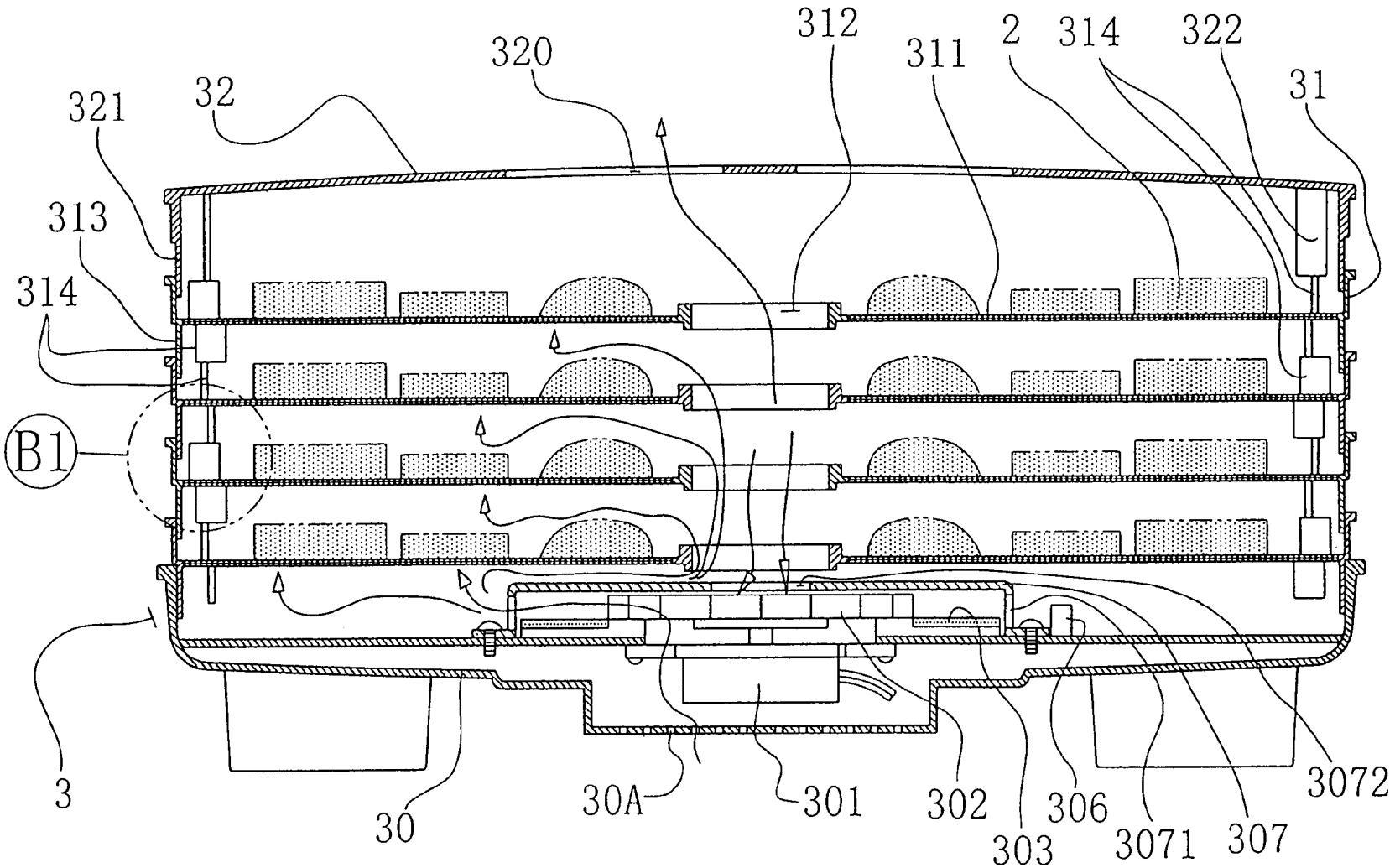
FIG. 5 is a schematic view showing the movement of hot air in accordance with the present invention.

The center and side of the hood 307 are respectively provided with a center air opening 3072 and a side air outlet net 3071. Referring to FIG. 5, the hot air is sucked via the center air opening 3072 and is then re-heated for further utilization.

The side air-outlet net 3071 is designed for enabling hot air from below to blow upward. The bottom seat 30 is mounted with a circuit board 304 and a control panel 305 and has a temperature sensor 306 for sensing the temperature of the heater 303. The central portion of the netted rack 31 has a netted board 311 having upper and lower circumferential edge being mounted with a support block 314. The two lateral sides form a 90-degree, and to provide fastening of the netted rack 31, the circumferential edge at the lower section is provided with a folded section 313. The center of the netted board 311 has a center opening 312 and the top section of the top cover 32 has a plurality of air openings 320. Similarly, the height of the space for storage can be increased by providing a support block 322 to act with the bottom support block 314. The lower edge is a folded section 321 to fasten with the netted rack 31.

Figure 6A:
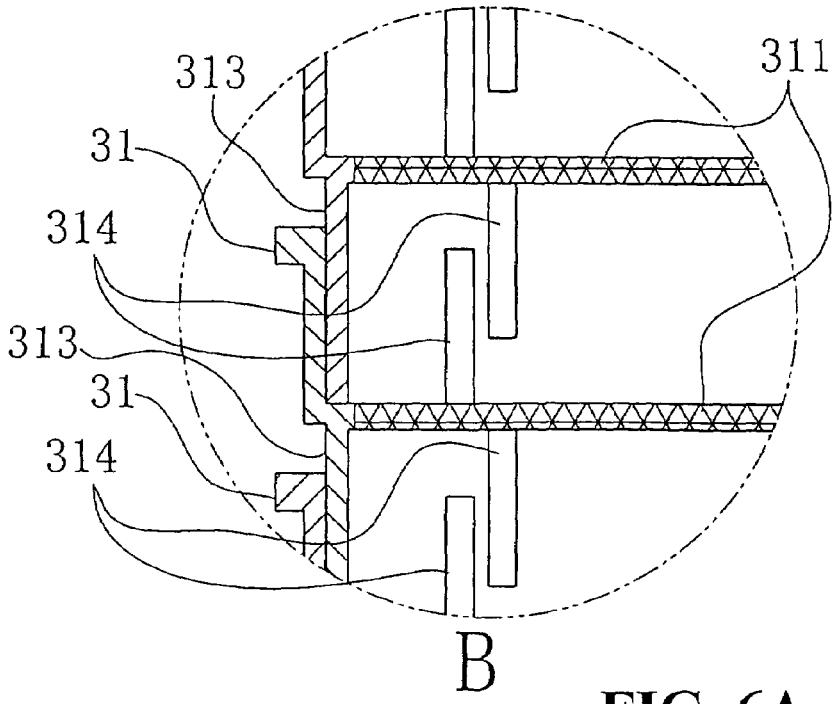
FIG. 6A is a schematic view showing the portion B of FIG.4.
Figure 6B:
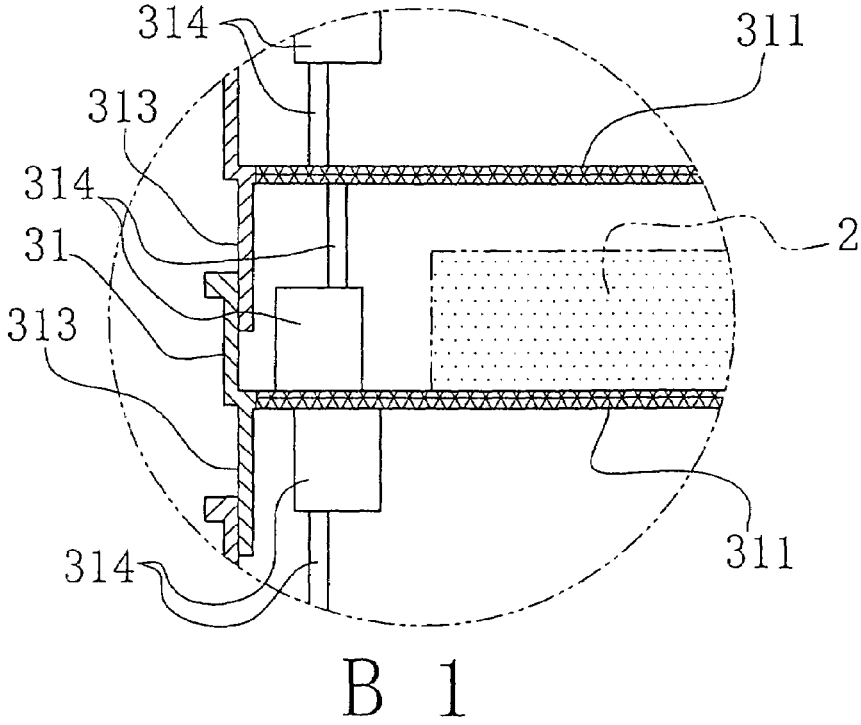
FIG. 6B is a schematic view showing the portion B1 of FIG. 5 of the present invention.

Referring to FIGS. 5, 6A and 6B, a fan 302 is used to blow hot air for recycling such that the hot air passes through the heater 303 at the interior of the hood 307 for heating. Thus, energy is conserved. The hot air is blown upward from the bottom via the netted board 311 so tat the vegetable cutting 2 is dried rapidly. The moisture gets away from the air opening 320 and will not be accumulated at the dryer body 3. As shown in FIGS. 4 and 6B, if the netted rack 31 and the top cover are to be lifted, as shown in FIGS. 5, 6A and 6B, the netted rack 31 is to be rotated through an angle of 180 degrees. The support blocks 314 bear against each other in a 90° direction, and the space of the netted board 311 is increased, and the height of the vegetable or fruit cutting 2 can be increased.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiment, but only by the scope of the appended claims.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A dryer for vegetables and fruits, comprising:

a base seat provided with a motor and an upward fan;

a plurality of netted racks stacked together and mounted on a top of said base seat;

a top cover mounted on a top of said netted racks;

a heater mounted surrounding said base sea for providing heat energy;

a hood enclosing said fan and said heater for providing hot air recycling and providing hot air being blowing downward, said hood having a center air opening and a side air outlet net, hot air being sucked via said center air opening and then being reheated for further utilization, said side air outlet being for enabling hot air from below to blow upward;

said bottom seat being provided with a circuit board and a control panel and having a temperature sensor for sensing temperature of said heater;

each of said netted racks having a netted board, said netted board having an upper side and a lower side provided with a plurality of support blocks, said support blocks being positioned so that when an upper one of said netted racks is rotated through an angle of 180 degrees, the support blocks of the upper one of said netted racks will bear against the support blocks of a lower one of said netted racks thereby increasing interior height between said upper and lower netted racks, said netted racks having a center opening, a top section of said top cover having a plurality of air openings;

whereby said fan is used to blow hot air for recycling so that the hot air passes through said heater for heating and the hot air is blown upward from a bottom of said dryer through said netted board, moisture gets away from said air openings of said top cover and will not be accumulated in said dryer, and interior height between said upper and lower netted racks can be adjusted by rotating the upper one of said netted racks through an angle of 180 degrees.

* * * * *